US008235549B2

(12) United States Patent
Gingrich, III et al.

(10) Patent No.: US 8,235,549 B2
(45) Date of Patent: Aug. 7, 2012

(54) SOLID STATE LIGHTING ASSEMBLY

(75) Inventors: Charles Raymond Gingrich, III, Mechanicsburg, PA (US); Matthew Edward Mostoller, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 420 days.

(21) Appl. No.: 12/634,416

(22) Filed: Dec. 9, 2009

(65) Prior Publication Data

US 2011/0134634 A1 Jun. 9, 2011

(51) Int. Cl.
*F21V 23/06* (2006.01)

(52) U.S. Cl. ..... 362/249.02; 362/373; 362/651; 362/294

(58) Field of Classification Search ..... 362/264, 362/545, 547, 549, 548; 439/332, 337
See application file for complete search history.

(56) References Cited

U.S. PATENT DOCUMENTS

| | | | |
|---|---|---|---|
| 5,038,255 | A | 8/1991 | Nishihashi et al. |
| 5,283,716 | A | 2/1994 | Banitt et al. |
| 5,404,282 | A | 4/1995 | Klinke et al. |
| 5,660,461 | A | 8/1997 | Ignatius et al. |
| 6,318,886 | B1 | 11/2001 | Stopa et al. |
| 6,541,800 | B2 | 4/2003 | Barnett et al. |
| 6,667,544 | B1 | 12/2003 | Glenn |
| 6,817,735 | B2 | 11/2004 | Shimizu et al. |
| 6,911,731 | B2 | 6/2005 | Wu |
| 6,999,318 | B2 | 2/2006 | Newby |
| 7,306,353 | B2 | 12/2007 | Popovich et al. |
| 7,322,718 | B2 | 1/2008 | Setomoto et al. |
| 7,348,604 | B2 | 3/2008 | Matheson |
| 7,400,029 | B2 | 7/2008 | Shimada et al. |
| 7,540,761 | B2 * | 6/2009 | Weber et al. ..... 439/487 |
| 7,549,786 | B2 | 6/2009 | Higley et al. |
| 7,553,162 | B2 | 6/2009 | Isoda et al. |
| 2002/0113244 | A1 | 8/2002 | Barnett et al. |
| 2002/0114155 | A1 | 8/2002 | Katogi et al. |
| 2002/0176250 | A1 | 11/2002 | Bohler et al. |
| 2003/0063463 | A1 | 4/2003 | Sloan et al. |
| 2003/0094893 | A1 | 5/2003 | Ellens et al. |
| 2003/0112627 | A1 | 6/2003 | Deese |
| 2003/0189829 | A1 | 10/2003 | Shimizu et al. |
| 2004/0175189 | A1 | 9/2004 | Weber-Rabsilber et al. |
| 2004/0252501 | A1 | 12/2004 | Moriyama et al. |
| 2004/0264195 | A1 | 12/2004 | Chang et al. |
| 2005/0152146 | A1 | 7/2005 | Owen et al. |

(Continued)

FOREIGN PATENT DOCUMENTS

| | | |
|---|---|---|
| DE | 19818402 | 10/1999 |

(Continued)

*Primary Examiner* — Sharon Payne

(57) ABSTRACT

A solid state lighting assembly includes a socket having a base wall having a first side and a second side, and a first cavity outward of the first side and a second cavity outward of the second side. Contacts are held by the base wall. The contacts have mating fingers extending into the first and second cavities. A lighting printed circuit board (PCB) is removably positioned within the first cavity with at least one lighting component configured to be powered when electrically connected to corresponding mating fingers of the contacts. The lighting PCB is initially loaded into the first cavity in an unmated position and moved in the first cavity to a mated position. A driver PCB is positioned within the second cavity and is electrically connected to corresponding mating fingers of the contacts. The driver PCB has a power circuit configured to supply power to the lighting PCB when electrically connected to the contacts.

22 Claims, 6 Drawing Sheets

U.S. PATENT DOCUMENTS

| | | | | |
|---|---|---|---|---|
| 2005/0243558 | A1 | 11/2005 | Van Duyn | |
| 2006/0091410 | A1 | 5/2006 | Chen | |
| 2006/0262533 | A1 | 11/2006 | Lin et al. | |
| 2007/0025103 | A1 | 2/2007 | Chan | |
| 2007/0246712 | A1 | 10/2007 | Kim et al. | |
| 2007/0279921 | A1 * | 12/2007 | Alexander et al. | 362/368 |
| 2008/0220631 | A1 | 9/2008 | Isoda et al. | |
| 2008/0315214 | A1 | 12/2008 | Wall, Jr. et al. | |
| 2009/0009103 | A1 | 1/2009 | McKechnie et al. | |
| 2009/0009998 | A1 | 1/2009 | Malstrom et al. | |
| 2009/0108281 | A1 | 4/2009 | Keller et al. | |
| 2009/0130889 | A1 | 5/2009 | Daily et al. | |
| 2009/0146919 | A1 | 6/2009 | Kline et al. | |

FOREIGN PATENT DOCUMENTS

| | | |
|---|---|---|
| DE | 10319525 | 11/2004 |
| EP | 1098135 | 5/2001 |
| WO | WO 0173844 | 10/2001 |

* cited by examiner

SOLID STATE LIGHTING ASSEMBLY

CROSS REFERENCE TO RELATED APPLICATIONS

This Application Relates to U.S. patent application titled LED SOCKET ASSEMBLY, having Ser. No. 12/634,453, U.S. patent application titled SOLID STATE LIGHTING SYSTEM, having Ser. No. 12/634,492, U.S. patent application titled LED SOCKET ASSEMBLY, having Ser. No. 12/634,517, and U.S. patent application titled SOCKET ASSEMBLY WITH A THERMAL MANAGEMENT STRUCTURE, having Ser. No. 12/634,542 each filed concurrently herewith, the subject matter of each of which are herein incorporated by reference in their entirety.

BACKGROUND OF THE INVENTION

The subject matter herein relates generally to solid state lighting assemblies, and more particularly, to configurable solid state lighting assemblies.

Solid-state light lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and so on.

Solid-state lighting systems typically include different components that are assembled together to complete the final system. For example, the system typically consists of a driver, a controller, a light source, optics and a power supply. It is not uncommon for a customer assembling a lighting system to have to go to many different suppliers for each of the individual components, and then assemble the different components, from different manufacturers together. Purchasing the various components from different sources proves to make integration into a functioning system difficult. This non-integrated approach does not allow the ability to effectively package the final lighting system in a lighting fixture efficiently.

A need remains for a lighting system that may be efficiently packaged into a lighting fixture. A need remains for a lighting system that may be efficiently configured for an end use application.

BRIEF DESCRIPTION OF THE INVENTION

In one embodiment, a solid state lighting assembly is provided including a socket having a base wall having a first side and a second side, and a first cavity outward of the first side and a second cavity outward of the second side. Contacts are held by the base wall. The contacts have mating fingers extending into the first and second cavities. A lighting printed circuit board (PCB) is removably positioned within the first cavity with at least one lighting component configured to be powered when electrically connected to corresponding mating fingers of the contacts. The lighting PCB is initially loaded into the first cavity in an unmated position and moved in the first cavity to a mated position. A driver PCB is positioned within the second cavity and is electrically connected to corresponding mating fingers of the contacts. The driver PCB has a power circuit configured to supply power to the lighting PCB when electrically connected to the contacts.

In another embodiment, a solid state lighting assembly is provided that includes a socket having a base wall having a first side and a second side with a first cavity outward of the first side and a second cavity outward of the second side. An anode contact is embedded within the base wall with the anode contact having mating fingers positioned within the first and second cavities. A cathode contact is embedded within the base wall with the cathode contact having mating fingers positioned within the first and second cavities. A lighting printed circuit board (PCB) is positioned within the first cavity having at least one lighting component configured to be powered when electrically connected to the mating fingers positioned in the first cavity. A driver PCB is positioned within the second cavity with a power circuit configured to supply power to the lighting PCB when electrically connected to the mating fingers in the second cavity.

In a further embodiment, a solid state lighting assembly is provided including a socket having a base wall between a first cavity and a second cavity that supports an anode contact and a cathode contact. The assembly also includes a set of lighting PCBs comprising at least two different types of lighting PCBs, where a select one of the lighting PCBs is positioned within the first cavity and is electrically connected to the anode contact and the cathode contact. The assembly also includes a set of driver PCBs comprising at least two different types of driver PCBs, where a select one of the driver PCBs is positioned within the second cavity and is electrically connected to the anode contact and the cathode contact.

DETAILED DESCRIPTION OF THE INVENTION

Figure 1:
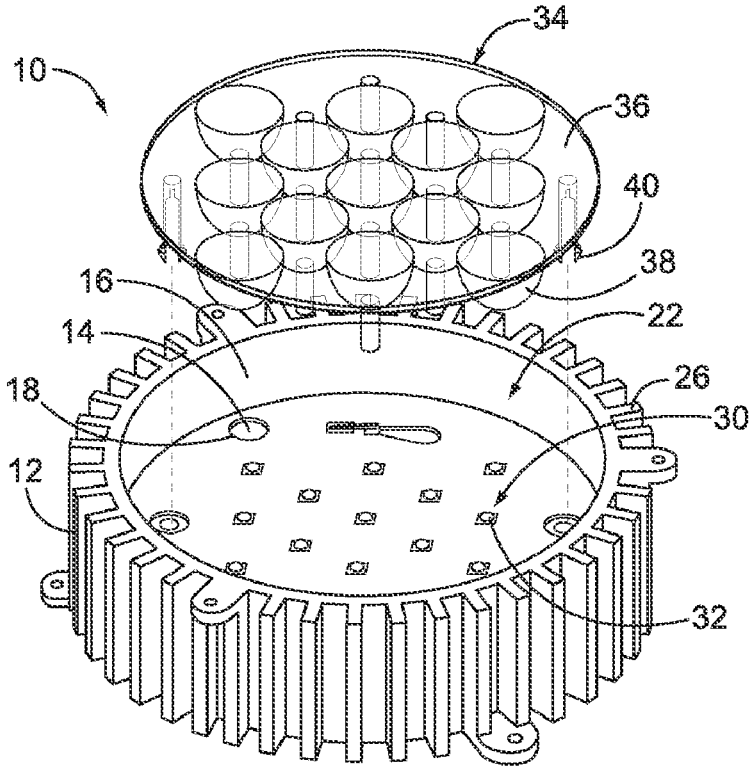
FIG. 1 is a top perspective view of a solid state lighting assembly formed in accordance with an exemplary embodiment.

FIG. 1 is a top perspective view of a solid state lighting assembly 10 formed in accordance with an exemplary embodiment. The assembly 10 represents a light engine for a lighting fixture. In an exemplary embodiment, the assembly 10 is part of a light engine that is used for residential, commercial or industrial use. The assembly 10 may be used for general purpose lighting, or alternatively, may have a customized application or end use.

The assembly 10 includes a socket 12 having a base wall 14 and an outer wall 16 surrounding the base wall 14. The base wall 14 has a first side 18 facing upward and a second side 20 (shown in FIG. 2) facing downward. The outer wall 16 surrounds the base wall 14 to define a first cavity 22 outward of the first side 18 and a second cavity 24 (shown in FIG. 2) outward of the second side 20. In the illustrated embodiment, the base wall 14 is circular in shape and the first cavity 22 is cylindrical in shape. However, it is realized that the base wall 14 and first cavity 22 may be shaped differently in alternative embodiments.

In an exemplary embodiment, the socket 12 is manufactured from a thermally conductive polymer to define a heat sink. Heat is dissipated from the base wall 14 outward to the outer wall 16. The outer wall 16 includes a plurality of heat dissipating fins 26. The fins 26 have a large surface area exposed to ambient air to dissipate heat from the outer wall 16.

The assembly 10 includes a lighting printed circuit board (PCB) 30 positioned within the first cavity 22. The lighting PCB 30 has at least one solid state lighting component 32. In an exemplary embodiment, the lighting component 32 is a light emitting diode (LED), and may be referred to hereinafter as LED 32. Other types of solid state lighting components may be used in alternative embodiments. The LEDs 32 are arranged in a predetermined pattern on an outer surface of the lighting PCB 30 to create a predetermined lighting effect.

The assembly 10 includes an optics module 34 coupled to the socket 12 and/or the lighting PCB 30. The optics module 34 has a lens 36 and one or more optic bodies 38 that focus the light produced by the LEDs 32. The optic bodies 38 have refractive and/or reflective properties to direct the light produced by the LEDs 32. Optionally, a different optic body 38 may be associated with and positioned above a corresponding LED 32. The optics module 34 includes one or more latches 40 to secure the optics module 34 to the socket 12. Other types of fastening means may be used in alternative embodiments. In an exemplary embodiment, a non-permanent fastening means is used to secure the optics module 34 such that the optics module 34 may be quickly and easily removed from the socket 12, such as to replace the optics module 34 or to gain access to the first cavity 22 to remove and/or replace the lighting PCB 30.

Figure 2:
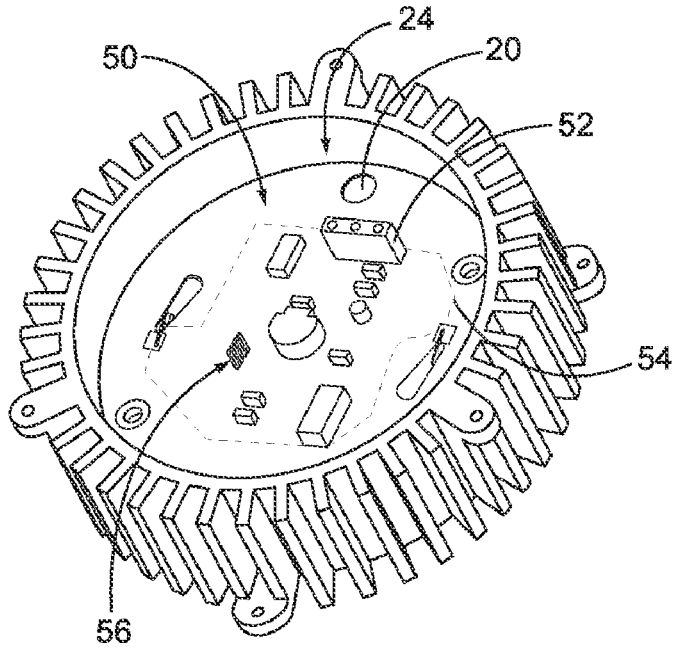
FIG. 2 is a bottom perspective view of the assembly shown in FIG. 1.

FIG. 2 is a bottom perspective view of the assembly 10 illustrating the second side 20 of the base wall 14 and the second cavity 24. Optionally, the second cavity 24 may be sized and shaped similar to the first cavity 22 (shown in FIG. 1). Alternatively, the second cavity 24 may be sized and shaped differently than the first cavity 22.

The assembly 10 includes a driver PCB 50 positioned within the second cavity 24. The driver PCB 50 is configured to be electrically connected to the lighting PCB 30 (shown in FIG. 1) to supply power to the lighting PCB 30. The driver PCB 50 receives a line voltage from a power source (not shown), such as through a power connector 52 mounted to the driver PCB 50. In the illustrated embodiment, the power connector 52 is represented by a poke-in type connector having openings configured to receive individual wires therein (e.g. hot, ground, neutral). The line voltage may be AC or DC power. The driver PCB 50 controls the power supply to the power output according to a control protocol. The driver PCB 50 includes a driver power circuit 54 having various electronic components (e.g. microprocessors, capacitors, resistors, transistors, integrated circuit, and the like) that create an electronic circuit or control circuit with a particular control protocol. The driver PCB 50 takes the power from the power source and outputs a power output to the lighting PCB 30 according to the control protocol. In an exemplary embodiment, the driver PCB 50 outputs a constant current to the lighting PCB 30, such as 350 mA of constant current. Different types of driver PCBs 50 may have different control protocols and may thus control the power supply differently, such as at a different output level, or according to certain control functions (e.g. wireless control, filtering, light control, dimming control, occupancy control, light sensing control, and the like).

In an exemplary embodiment, the driver PCB 50 includes one or more expansion connector(s) 56 forming part of the driver power circuit 54. The expansion connector 56 is configured to mate with an expansion module 60 (shown in FIG. 3) to have a predetermined functionality. Different types of expansion modules 60 may be provided with different functionality. Depending on the type of expansion module(s) connected to the driver PCB 50, the driver power circuit 54 may be controlled differently. For example, the control protocol may be modified by attaching an expansion module 60 to the driver PCB 50, which ultimately may alter the lighting effect and output of the assembly 10.

Figure 3:
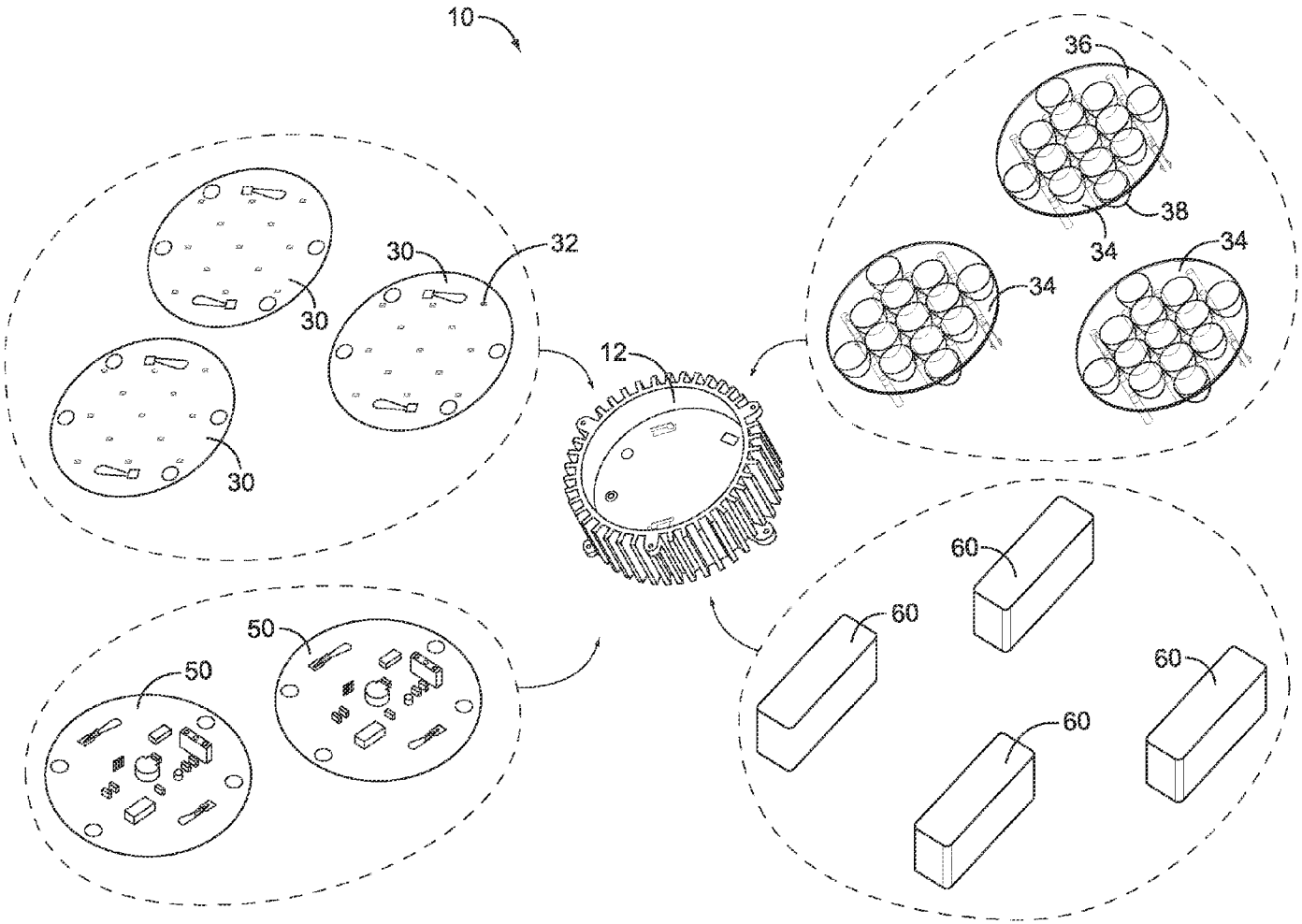
FIG. 3 is an exploded view of the assembly shown in FIG. 1.

FIG. 3 is an exploded view of the assembly 10 illustrating the socket 12, a set of lighting PCBs 30, a set of optics modules 34, a set of driver PCBs 50 and a set of expansion modules 60. The assembly 10 is modular in design to allow for different combinations of components to create a particular assembly having a particular lighting effect. The various components of the assembly 10 are interchangeable to change different aspects and functionality of the assembly 10.

The set of lighting PCBs 30 includes at least two different types of lighting PCBs 30, where the different types of lighting PCBs 30 differ from one another, such as by having a different number of LEDs 32, by having the LEDs 32 in different positions on the surface of the lighting PCBs 30 and/or by having different colored LEDs 32 on the lighting PCBs 30 (e.g. warm white, neutral white, cool white, custom color). The set of optic modules 34 includes at least two different types of optic modules 34, where the different types of optic modules 34 differ from one another by having a different number of optic bodies 38, different lighting patterns (e.g. wide illumination, medium illumination, spot illumination, elliptical illumination, and the like), different types of lenses 36, different refractive indexes, and the like.

The set of driver PCBs 50 includes at least two different types of driver PCBs 50, where the different types of driver PCBs 50 differ from one another, such as by having different control protocols, different output currents, different power efficiencies, different filtering functions, different circuit protection features, and the like. The set of expansion modules 60 includes at least two different types of expansion modules 60, where the different types of expansion modules 60 differ from one another by having different control circuits, having different functionality, having different circuit protection features, and the like. As such, the expansion modules 60 can affect the control protocol of the connected driver PCB 50, such as allowing wireless control, filtering, light control, and the like. For example, the different expansion modules 60 may include different components, such as an antenna for wireless control, a remote dimmer device for dimming the lighting, a remote occupancy sensor for controlling the lighting based on occupancy of a person or object in the vicinity of the assembly 10, a remote light sensor for sensing an amount of light in the vicinity of the assembly 10, just to name a few.

During assembly, one of the lighting PCBs 30, one of the optics modules 34, and one of the driver PCBs 50 are selected for use depending on the desired lighting effects. The selected lighting PCB 30, optics modules 34, and driver PCB 50 are assembled together with the socket 12 such that the lighting PCB 30 is electrically connected to the driver PCB 50. When the driver PCB 50 is connected to the power source, the assembly 10 may be operated according to the control protocol of the driver PCB 50. Optionally, any number of the expansion modules 60 may be selected for use with the assembly 10. The expansion module(s) 60 are connected to the driver PCB 50, and once connected, the control protocol of the driver PCB 50 is changed according to the functionality of the expansion module 60 (e.g. wireless control, filtering, lighting control, and the like).

Figure 4:
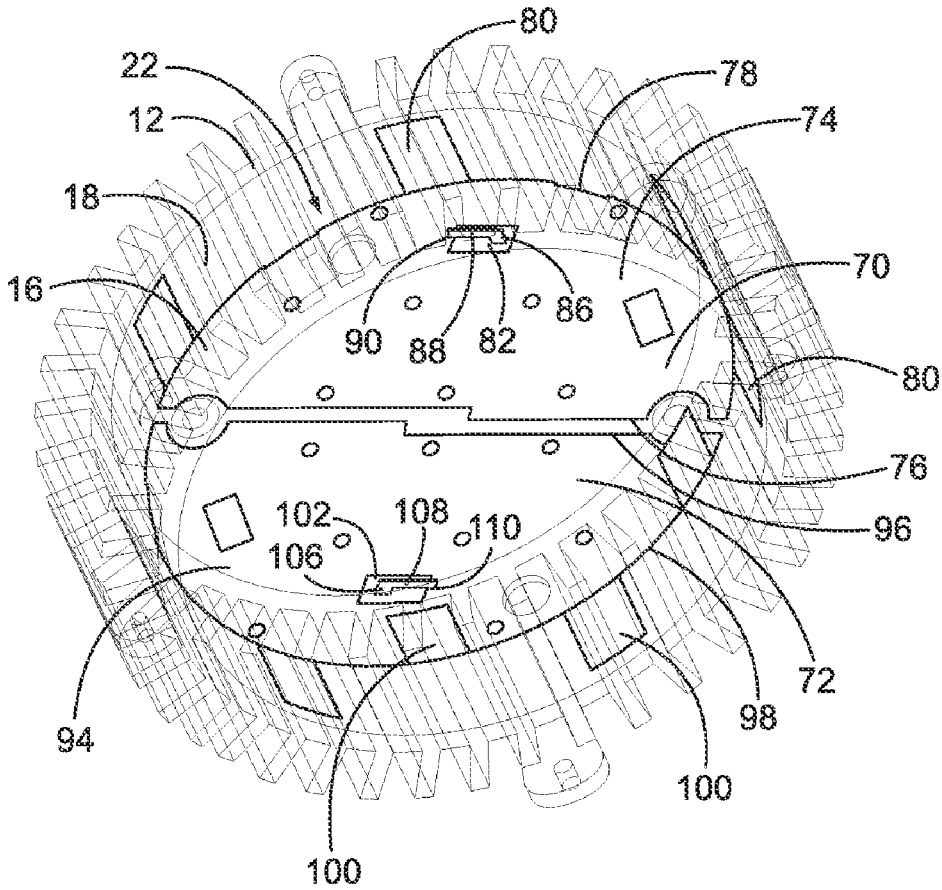
FIG. 4 illustrates anode and cathode contacts housed within a socket of the assembly shown in FIG. 1.

FIG. 4 illustrates anode and cathode contacts 70, 72 housed within the socket 12. The anode and cathode contacts 70, 72 are used to electrically couple the lighting PCB 30 (shown in FIG. 3) and the driver PCB 50 together. In an exemplary embodiment, the contacts 70, 72 are embedded within the base wall 14 of the socket 12. Optionally, the socket 12 may be molded over the contacts 70, 72 when the socket 12 is formed to embed the contacts 70, 72 within the base wall 14. Alternatively, the contacts 70, 72 may be loaded into a groove formed in the base wall 14, such as through a slot formed in the outer wall 16. In another alternative embodiment, the contacts 70, 72 may be placed on either the first side 18 (shown in FIG. 1) or the second side 20 (shown in FIG. 2), and secured to the corresponding surface of the base wall 14.

The anode contact 70 includes a planar contact base 74 having an inner edge 76 that generally extends along and faces the cathode contact 72 and an outer edge 78 opposite the inner edge 76. In an exemplary embodiment, the planar contact base 74 is generally semi-circular in shape with the arc portion defining the outer edge 78 and with the diameter defining the inner edge 76. The outer edge 78 is generally coincident with the outer wall 16. The anode contact 70 is both electrically conductive and thermally conductive. The anode contact 70 has a higher coefficient of thermal transfer than the socket 12, and as such, is a better thermal conductor than the socket 12. With the anode contact 70 being embedded within roughly half of the base wall 14 (and the cathode contact 72 being embedded within roughly the other half of the base wall 14), the anode contact 70 operates efficiently as a heat spreader, spreading the heat radially outward toward the outer wall 16.

In an exemplary embodiment, the anode contact 70 includes a plurality of tabs 80 at the outer edge 78. The tabs 80 are embedded in the outer wall 16 and operate to spread the heat into the outer wall 16. Optionally, the anode contact 70 may include both upwardly extending tabs and downwardly extending tabs to spread the heat both above and below the base wall 14 into the outer wall 16. Any number of tabs 80 may be provided. The tabs 80 may be stamped and formed with the anode contact 70.

Figure 6:
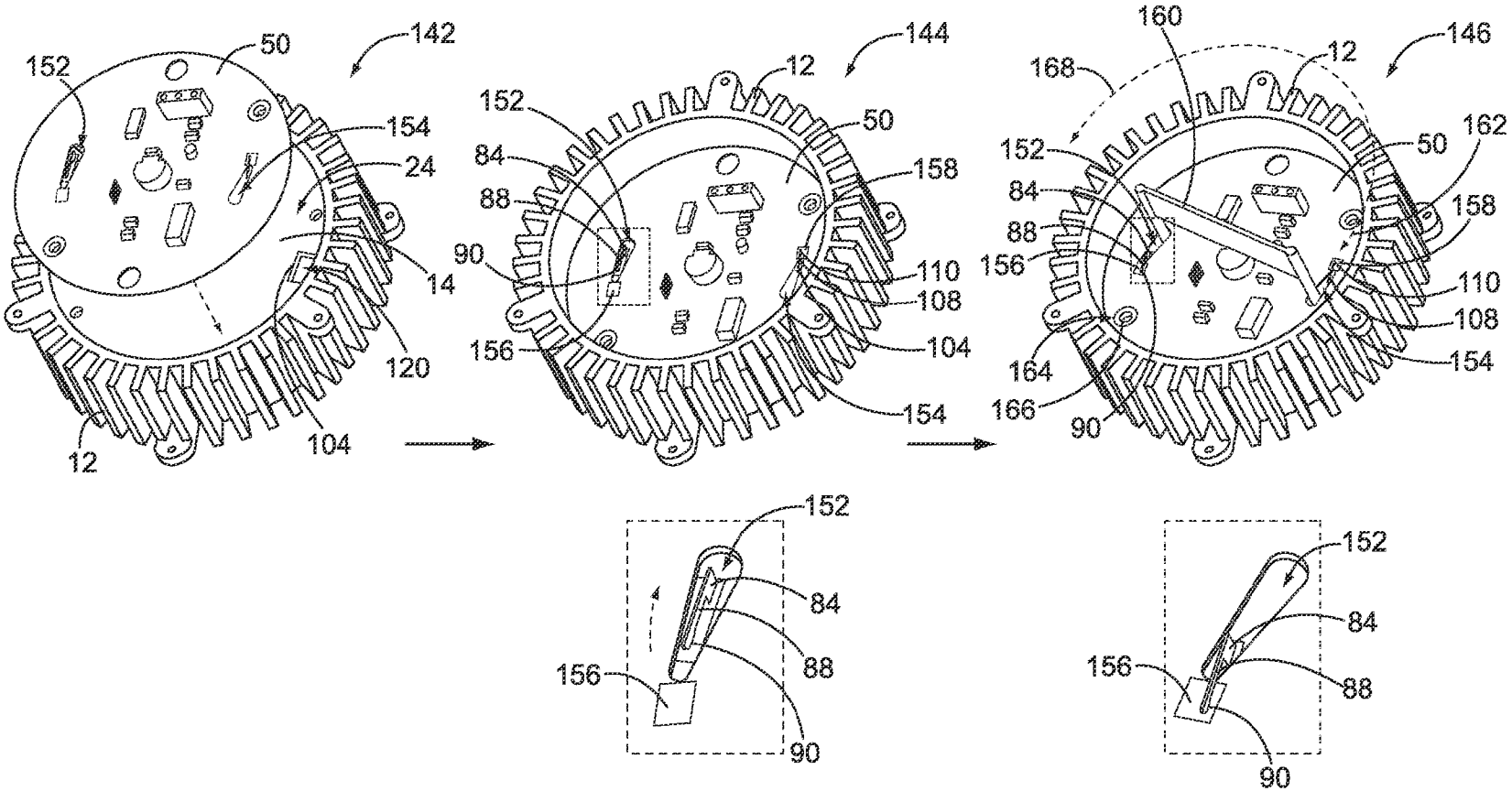
FIG. 6 illustrates another assembly process for the lighting assembly shown in FIG. 1.

The anode contact 70 includes a first anode mating finger 82 and a second anode mating finger 84 (shown in FIG. 6). The first and second anode mating fingers 82, 84 are bent out of plane with respect to the planar contact base 74. Optionally, the mating fingers 82, 84 may be bent approximately perpendicular to the contact base 74. The mating fingers 82, 84 are bent in opposite directions, with the first anode mating finger 82 positioned within the first cavity 22 and the second anode mating finger 84 positioned within the second cavity 24. The first anode mating finger 82 is configured for connection to the lighting PCB 30 and the second anode mating finger 84 is configured for connection to the driver PCB 50. As such, the anode contact 70 is configured to electrically interconnect the lighting PCB 30 with the driver PCB 50.

The first and second anode mating fingers 82, 84 may be identically formed. The mating fingers 82, 84 may be stamped and formed with the anode contact 70. In the illustrated embodiment, the mating fingers 82, 84 are L shaped with a leg portion 86 extending outward from the contact base 74 in a perpendicular direction. The leg portion 86 gives the mating fingers 82, 84 a vertical height from the contact base 74. Each mating finger 82, 84 also includes an arm portion 88 that extends outward from the leg portion 86. Optionally, the arm portion 88 may be approximately perpendicular to the leg portion 86. The arm portion 88 is cantilevered from the leg portion 86 for a distance. Optionally, the arm portion 88 may have a mating end 90 at a distal end thereof. The mating end 90 is configured to engage the lighting PCB 30 or the driver PCB 50. The mating fingers 82, 84 may constitute spring beams capable of being at least partially deflected when mated to the lighting PCB 30 or the driver PCB 50 and provide a normal force on the lighting PCB 30 or the driver PCB 50 to ensure contact thereto. The spring beams may also provide a hold down force to hold the lighting PCB 30 or the driver PCB 50 in place when mated thereto.

The cathode contact 72 may be substantially identical to the anode contact 70. Optionally, the anode and cathode contacts 70, 72 may be the same part number, and thus interchangeable. The cathode contact 72 includes a planar contact base 94 having an inner edge 96 that generally extends along and faces the inner edge 76 of the anode contact 70. The cathode contact 72 also includes an outer edge 98 opposite the inner edge 96 that is generally coincident with the outer wall 16. The cathode contact 72 is both electrically conductive and thermally conductive. The anode contact 70 has a higher coefficient of thermal transfer than the socket 12, and as such, is a better thermal conductor than the socket 12. With the cathode contact 72 being embedded within roughly half of the base wall 14 (and the anode contact 70 being embedded within roughly the other half of the base wall 14), the cathode contact 72 operates efficiently as a heat spreader, spreading the heat radially outward toward the outer wall 16.

In an exemplary embodiment, the cathode contact 72 includes a plurality of tabs 100 at the outer edge 98. The tabs 100 are embedded in the outer wall 16 and operate to spread the heat into the outer wall 16. Optionally, the cathode contact 72 may include both upwardly extending tabs and downwardly extending tabs to spread the heat both above and below the base wall 14 into the outer wall 16. Any number of tabs 100 may be provided. The tabs 100 may be stamped and formed with the anode contact 70.

The cathode contact 72 includes a first cathode mating finger 102 and a second cathode mating finger 104 (shown in FIG. 6). The first and second cathode mating fingers 102, 104 are bent out of plane with respect to the planar contact base 94. Optionally, the mating fingers 102, 104 may be bent approximately perpendicular to the contact base 94. The mating fingers 102, 104 are bent in opposite directions, with the first cathode mating finger 102 positioned within the first cavity 22 and the second cathode mating finger 104 positioned within the second cavity 24. The first cathode mating finger 102 is configured for connection to the lighting PCB 30 and the second cathode mating finger 104 is configured for connection to the driver PCB 50. As such, the cathode contact 72 is configured to electrically interconnect the lighting PCB 30 with the driver PCB 50.

The first and second cathode mating fingers 102, 104 may be identically formed and may be similar to the mating fingers 82, 84 of the anode contact 70. The mating fingers 102, 104 may be stamped and formed with the cathode contact 72. In the illustrated embodiment, the mating fingers 102, 104 are L shaped with a leg portion 106 extending outward from the contact base 94 in a perpendicular direction. The leg portion 106 gives the mating fingers 102, 104 a vertical height from the contact base 94. Each mating finger 102, 104 also includes an arm portion 108 that extends outward from the leg portion 106. Optionally, the arm portion 108 may be approximately perpendicular to the leg portion 106. The arm portion 108 is cantilevered from the leg portion 106 for a distance. Optionally, the arm portion 108 may have a mating end 110 at a distal end thereof. The mating end 110 is configured to engage the lighting PCB 30 or the driver PCB 50. The mating fingers 102, 104 may constitute spring beams capable of being at least partially deflected when mated to the lighting PCB 30 or the driver PCB 50 and provide a normal force on the lighting PCB 30 or the driver PCB 50 to ensure contact thereto. The spring beams may also provide a hold down force to hold the lighting PCB 30 or the driver PCB 50 in place when mated thereto.

In an alternative embodiment, rather than utilizing the contacts 70, 72 to provide an electrical path through the socket 12, the socket 12 may include one or more metal heat spreaders in the form of metal plates in place of the contacts 70, 72. The heat spreaders are embedded within, or mounted to, the base wall 14. When embedded within the base wall 14, thermal paths are created between the PCBs 30, 50 and the heat spreaders through the material of the base wall 14. The heat spreaders have a higher coefficient of thermal transfer than the base wall 14, and thus spread the heat to the outer wall 16 more efficiently than the base wall 14 alone. The heat spreaders may have one or more openings that allow contacts and/or mating fingers to pass between the cavities 22, 24 without physically touching the heat spreaders. Optionally, the heat spreaders may make direct contact with the driver PCB 50 and/or the lighting PCB 30 to more efficiently dissipate heat therefrom.

Figure 5:
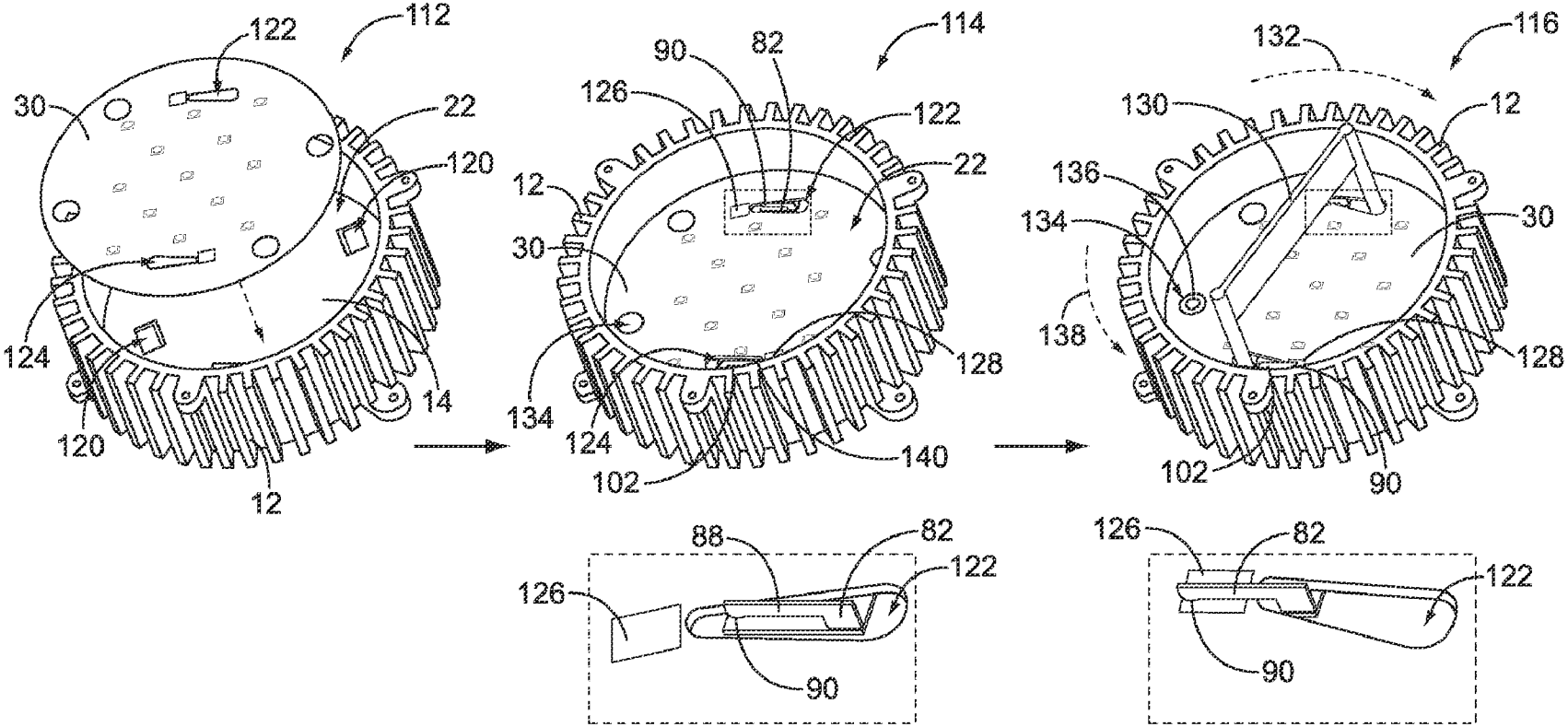
FIG. 5 illustrates an assembly process for the lighting assembly shown in FIG. 1.

FIG. 5 illustrates an assembly process for installing the lighting PCB 30 into the socket 12. The lighting PCB 30 is initially aligned with the first cavity 22 of the socket 12 into an aligned position 112, and then moved to a loaded, unmated position 114, and finally is moved to a mated position 116. As shown in FIG. 5, the first anode and cathode mating fingers 82, 102 extend into the first cavity 22 through openings 120 in the base wall 14.

In an exemplary embodiment, the lighting PCB 30 includes slots 122, 124 formed therethrough. Optionally, the slots 122, 124 may be aligned 180° apart from one another on opposite sides of the lighting PCB 30. The lighting PCB 30 includes an anode contact 126 and a cathode contact 128 also on opposite sides of the lighting PCB 30 from one another. The anode contact 126 is aligned with, and positioned adjacent the slot 122. The cathode contact 128 is aligned with, and positioned adjacent the slot 124. As the lighting PCB 30 is loaded into the first cavity 22 from the initial aligned position 112 to the loaded, unmated position 114, the anode mating finger 82 is loaded through the slot 122 and the cathode mating finger 102 is loaded through the slot 124. As such, the anode mating finger 82 is aligned with, and positioned adjacent to, the anode contact 126 and the cathode mating finger 102 is aligned with, and positioned adjacent to, the cathode contact 128.

When loaded into the first cavity 22, the lighting PCB 30 is in the unmated position 114 and is thus not electrically connected to the anode and cathode mating fingers 82, 102. During assembly, the lighting PCB 30 is shifted within the first cavity 22 from the unmated position 114 to the mated position 116. The lighting PCB 30 is electrically connected to the first anode mating finger 82 and the first cathode mating finger 102 in the mated position 116. Optionally, a tool 130 may be used to shift the lighting PCB 30 to the mated position 116. The same tool 130 may also be used to shift the lighting PCB 30 back to the unmated position 114, such as when it is necessary or desired to remove the lighting PCB 30 from the socket 12. In the illustrated embodiment, the tool 130 is used to shift the lighting PCB 30 in a mating direction 132 by rotating the lighting PCB 30 in a clockwise direction. Other movement directions are contemplated for moving the lighting PCB 30 from the unmated position to the mated position, such as rotation in a counterclockwise direction, rotating the lighting PCB 30 about an axis that is non perpendicular to the plane of the lighting PCB 30, sliding the lighting PCB 30 in a linear mating direction, and the like.

As the lighting PCB 30 is shifted to the mated position, the anode and cathode contacts 126, 128 are slid along the arm portions 88, 108 of the mating fingers 82, 102. The mating ends 90, 110 engage the anode and cathode contacts 126, 128 in the mated position.

In an exemplary embodiment, the lighting PCB 30 includes one or more opening(s) 134. The base wall 14 of the socket 12 includes one or more protrusion(s) 136 corresponding to the opening(s) 134. The protrusions 136 may constitute latches. In the mated position 116, the protrusions 136 are received in the openings 134. The protrusions 136 interfere with the openings 134 to resist shifting of the lighting PCB 30, such as in an unmating direction 138 opposite to the mating direction 132.

FIG. 6 illustrates another assembly process for installing the driver PCB 50 into the socket 12. The driver PCB 50 is initially aligned with the second cavity 24 of the socket 12 into an aligned position 142, and then moved to a loaded, unmated position 144, and finally is moved to a mated position 146. As shown in FIG. 6, the second anode and cathode mating fingers 84, 104 extend into the second cavity 24 through the openings 120 in the base wall 14.

In an exemplary embodiment, the driver PCB 50 includes slots 152, 154 formed therethrough. Optionally, the slots 152, 154 may be aligned 180° apart from one another on opposite sides of the driver PCB 50. The driver PCB 50 includes an anode contact 156 and a cathode contact 158 also on opposite sides of the driver PCB 50 from one another. The anode contact 156 is aligned with, and positioned adjacent the slot 152. The cathode contact 158 is aligned with, and positioned adjacent the slot 154. As the driver PCB 50 is loaded into the second cavity 24 from the initial aligned position 142 to the loaded, unmated position 144, the anode mating finger 84 is loaded through the slot 152 and the cathode mating finger 104 is loaded through the slot 154. As such, the anode mating finger 84 is aligned with, and positioned adjacent to, the anode contact 156 and the cathode mating finger 104 is aligned with, and positioned adjacent to, the cathode contact 158.

When loaded into the second cavity 24, the driver PCB 50 is in the unmated position 144 and is thus not electrically connected to the anode and cathode mating fingers 84, 104. During assembly, the driver PCB 50 is shifted within the second cavity 24 from the unmated position 144 to the mated position 146. The driver PCB 50 is electrically connected to the second anode mating finger 84 and the second cathode mating finger 104 in the mated position 146. A tool 160 may be used to shift the driver PCB 50 to the mated position 146. Optionally, the tool 160 may be the same tool 130 (shown in FIG. 5). The same tool 160 may also be used to shift the driver PCB 50 back to the unmated position 144, such as when it is necessary or desired to remove the driver PCB 50 from the socket 12. In the illustrated embodiment, the tool 160 is used to shift the driver PCB 50 in a mating direction 162 by rotating the driver PCB 50 in a clockwise direction. Other movement directions are contemplated for moving the driver PCB 50 from the unmated position to the mated position, such as rotation in a counterclockwise direction, rotating the driver PCB 50 about an axis that is non perpendicular to the plane of the driver PCB 50, sliding the driver PCB 50 in a linear mating direction, and the like.

As the driver PCB 50 is shifted to the mated position, the anode and cathode contacts 156, 158 are slid along the arm portions 88, 108 of the mating fingers 84, 104. The mating ends 90, 110 engage the anode and cathode contacts 156, 158 in the mated position.

In an exemplary embodiment, the driver PCB 50 includes one or more opening(s) 164. The base wall 14 of the socket 12 includes one or more protrusion(s) 166 corresponding to the opening(s) 164. Optionally, the protrusions 166 may constitute latches. In the mated position 146, the protrusions 166 are received in the openings 164. The protrusions 166 interfere with the openings 164 to resist shifting of the driver PCB 50, such as in an unmating direction 168 opposite to the mating direction 162.

Figure 7:
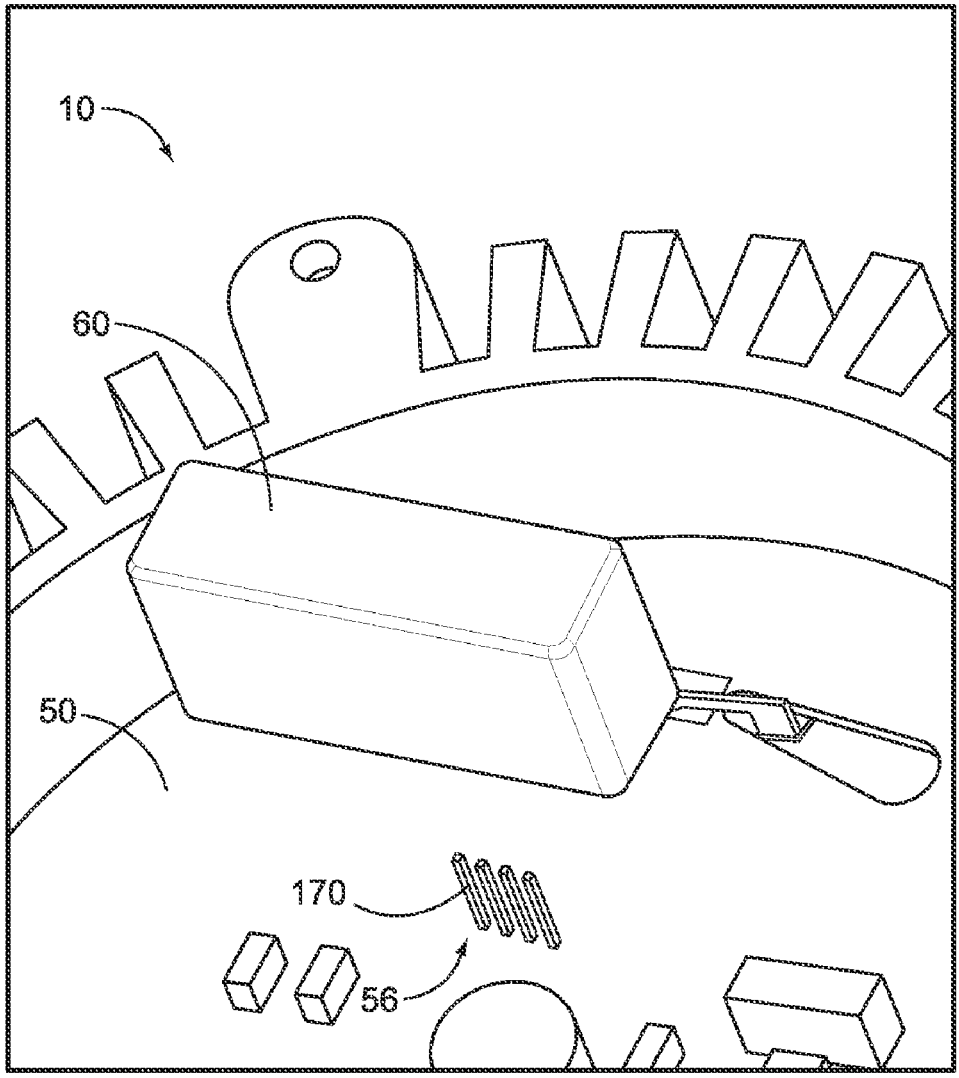
FIG. 7 illustrates yet another assembly process for the lighting assembly shown in FIG. 1.

FIG. 7 illustrates yet another assembly process for the assembly 10 showing one of the expansion modules 60 being coupled to the driver PCB 50. The expansion module 60 is being coupled to the expansion connector 56. In the illustrated embodiment, the expansion connector 56 includes a plurality of pins 170 terminated to the driver PCB 50. The expansion module 60 is mated to the expansion connector 56 in a pluggable manner. The expansion module 60 is configured to be mated and unmated quickly and efficiently. For example, the expansion module 60 may be removed from the expansion connector 56 and replaced with a different expansion module 60 having different functionality. As such, the driver PCB 50 is configurable and modifiable using different expansion modules 60. Any number of expansion connectors 56 may be provided on the driver PCB 50 to allow more than one expansion module 60 to be connected to the driver PCB 50.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A solid state lighting assembly comprising:

a socket having a base wall with first and second sides, the socket having a first cavity proximate the first side and a second cavity proximate the second side;

contacts held by the base wall, the contacts having mating fingers extending into the first and second cavities;

a lighting printed circuit board (PCB) removably positioned within the first cavity, the lighting PCB having at least one lighting component configured to be powered when electrically connected to corresponding mating fingers of the contacts, the lighting PCB being initially loaded into the first cavity in an unmated position and moved in the first cavity to a mated position; and a driver PCB positioned within the second cavity and electrically connected to corresponding mating fingers of the contacts, the driver PCB having a power circuit configured to supply power to the lighting PCB when electrically connected to the contacts.

2. The assembly of claim 1, wherein the lighting PCB and driver PCB are mated with the corresponding mating fingers at a separable mating interface such that the lighting PCB and driver PCB are configured to be repeatably removed from the first and second cavities.

3. The assembly of claim 1, wherein the first and second cavities are cylindrical in shape, the lighting and driver PCBs being circular in shape to fit within the first and second cavities, respectively, the lighting and driver PCBs being shifted within the first and second cavities by rotating the lighting and driver PCBs within the first and second cavities.

4. The assembly of claim 1, wherein the lighting PCB is twisted in a mating direction to the mated position and in an unmating direction to the unmated position, and wherein the driver PCB is twisted in a mating direction to a mated position and in an unmating direction to an unmated position.

5. The assembly of claim 1, wherein the lighting PCB includes contact pads on an outer surface thereof and the lighting PCB includes slots therethrough aligned with the contact pads, the lighting PCB being loaded into the first cavity such that the mating fingers are loaded through corresponding slots in alignment with the contact pads, the lighting PCB being shifted within the first cavity until the corresponding mating fingers engage the corresponding contact pads.

6. The assembly of claim 1, wherein the mating fingers extending into the first cavity have hook ends parallel to the first side of the base wall, the lighting PCB being captured between the hook ends and the base wall to hold the lighting PCB against the first side of the base wall.

7. The assembly of claim 1, wherein the socket is manufactured from a thermally conductive polymer to define a heatsink, the socket having an outer wall surrounding the base wall and defining the first and second cavities, the contacts being configured to spread heat from a central portion of the base wall to the outer wall.

8. The assembly of claim 1, wherein the contacts have planar contact bases embedded within the base wall of the socket, the mating fingers extending perpendicular to the contact bases into the first and second cavities.

9. The assembly of claim 1, wherein the driver PCB is removably positioned within the second cavity, the driver PCB being initially loaded into the second cavity in an unmated position and shifted within the cavity to a mated position, the driver PCB and the lighting PCB having contact pads not engaging the corresponding mating fingers when in the unmated positions and the contact pads engaging the corresponding mating fingers when in the mated positions.

10. A solid state lighting assembly comprising:

a socket having a base wall having a first side and a second side, the socket having a first cavity outward of the first side and a second cavity outward of the second side;

an anode contact embedded within the base wall, the anode contact having mating fingers positioned within the first and second cavities;

a cathode contact embedded within the base wall, the cathode contact having mating fingers positioned within the first and second cavities;

a lighting printed circuit board (PCB) positioned within the first cavity, the lighting PCB having at least one lighting component configured to be powered when electrically connected to the mating fingers positioned in the first cavity; and a driver PCB positioned within the second cavity, the driver PCB having a power circuit configured to supply power to the lighting PCB when electrically connected to the mating fingers in the second cavity.

11. The assembly of claim 10, wherein the lighting PCB and driver PCB are mated with the corresponding anode and cathode mating fingers at a separable mating interface such that the lighting PCB and driver PCB are configured to be repeatably removed from the first and second cavities.

12. The assembly of claim 10, wherein the lighting PCB includes contact pads on an outer surface thereof and the lighting PCB includes slots therethrough aligned with the contact pads, the lighting PCB being loaded into the first cavity such that the mating fingers positioned in the first cavity are loaded through corresponding slots in alignment with the contact pads, the lighting PCB being shifted within the first cavity until the mating fingers positioned in the first cavity engage the corresponding contact pads.

13. The assembly of claim 10, wherein the mating fingers positioned in the first cavity have hook ends parallel to the first side of the base wall, the lighting PCB being captured between the hook ends and the base wall to hold the lighting PCB against the first side of the base wall.

14. The assembly of claim 10, wherein the socket includes an outer wall surrounding the base wall, the outer wall having heat dissipating fins, the anode and cathode contacts each having tabs embedded within the outer wall to dissipate heat into the outer wall.

15. The assembly of claim 10, wherein the socket is manufactured from a thermally conductive polymer to define a heatsink, the socket includes an outer wall surrounding the base wall, the anode and cathode contacts being embedded within the base wall to define a heat spreader to spread heat from a central portion of the base wall to the outer wall.

16. A solid state lighting assembly comprising:

a socket having a base wall between a first cavity and a second cavity, the base wall supporting an anode contact and a cathode contact;

a set of lighting printed circuit boards (PCBs) comprising at least two different types of lighting PCBs, a select one of the lighting PCBs being positioned within the first cavity and electrically connected to the anode contact and the cathode contact; and a set of driver PCBs comprising at least two different types of driver PCBs, a select one of the driver PCBs being positioned within the second cavity and electrically connected to the anode contact and the cathode contact.

17. The assembly of claim 16, wherein the different types of lighting PCBs differ from one another by having light emitting diodes (LEDs) in different positions on a surface of the lighting PCBs and/or by having different colored LEDs on the lighting PCBs.

18. The assembly of claim 16, wherein the different types of driver PCBs differ from one another by having different output currents from one another.

19. The assembly of claim 16, further comprising a set of optic modules comprising at least two different types of optic modules, the different types of optic modules differ from one another by having different lighting patterns, a select one of the optic modules being coupled to the socket at the first cavity adjacent to the selected lighting PCB.

20. The assembly of claim 16, further comprising a set of expansion modules comprising at least two different types of expansion modules, the different types of expansion modules differ from one another by having different control circuits, a select one of the expansion modules being coupled to the driver PCB to affect a control protocol of the driver PCB.

21. A solid state lighting assembly comprising:

a socket having a base wall having a first side and a second side, the base wall having an outer perimeter, the socket having a first cavity outward of the first side and a second cavity outward of the second side;

a heat spreader embedded within the base wall, the heat spreader being metallic and having a higher coefficient of thermal transfer than the base wall;

a lighting printed circuit board (PCB) positioned within the first cavity proximate to the base wall, the lighting PCB having at least one lighting component; and a driver PCB positioned within the second cavity proximate to the base wall, the driver PCB being electrically connected to the lighting PCB through the base wall, the driver PCB having a power circuit configured to supply power to the lighting PCB when electrically connected to the lighting PCB, wherein the heat spreader dissipates heat from the lighting PCB and the driver PCB to the outer perimeter of the base wall.

22. The assembly of claim 21, wherein the heat spreader is in thermal contact with at least one of the lighting PCB and the driver PCB to create a direct thermal path therebetween.

* * * * *